United States Patent [19]

Miyachi et al.

[11] Patent Number: 4,459,925

[45] Date of Patent: Jul. 17, 1984

[54] CYCLE SEWING MACHINE

[75] Inventors: Nobuji Miyachi; Ken'iti Miyake, both of Kyoto, Japan

[73] Assignee: Miyachi Sewing Machine Co., Ltd., Kyoto, Japan

[21] Appl. No.: 415,882

[22] Filed: Sep. 7, 1982

[30] Foreign Application Priority Data

| | | | |
|---|---|---|---|
| Sep. 12, 1981 | [JP] | Japan | 56-144200 |
| Sep. 12, 1981 | [JP] | Japan | 56-144201 |
| Sep. 18, 1981 | [JP] | Japan | 56-139442[U] |

[51] Int. Cl.[3] ..... D05B 3/04; D05B 3/12; D05B 65/02; D05B 27/00

[52] U.S. Cl. ..... 112/70; 112/104; 112/121.15; 112/121.27; 112/163; 112/294; 112/297; 112/309

[58] Field of Search ..... 112/121.15, 121.27, 112/308, 309, 70, 65, 104, 163, 164, 166, 291, 294, 297

[56] References Cited

U.S. PATENT DOCUMENTS

| | | | |
|---|---|---|---|
| 2,868,151 | 1/1959 | Winz | 112/309 X |
| 3,482,537 | 12/1969 | Morin | 112/104 |
| 3,705,561 | 12/1972 | Sakawa et al. | 112/70 X |
| 3,884,164 | 5/1975 | Nakamura | 112/70 |
| 4,030,429 | 6/1977 | Boser et al. | 112/104 |
| 4,183,309 | 1/1980 | Bajer et al. | 112/70 X |

*Primary Examiner*—H. Hampton Hunter

*Attorney, Agent, or Firm*—Wenderoth, Lind & Ponack

[57] ABSTRACT

A cycle sewing machine equipped with an improved cloth feeding mechanism which is so arranged that, through rocking control of oscillating levers by a cloth feeding cam via cam rollers, a feed table is displaced in longitudinal directions of a sewing machine bed (i.e. in X directions) or in directions intersecting at right angles with the longitudinal directions (i.e. in Y directions), and by the composite movements as described above, the garment to be sewn is moved as desired with respect to sewing positions for two sewing needles vertically moving at predetermined positions, and thus, it has been made possible to simultaneously form the same seams at two positions of the garment in an efficient manner.

6 Claims, 21 Drawing Figures

CYCLE SEWING MACHINE

The present invention generally relates to a sewing apparatus and more particularly, to a Lock Stitch Bar Tacker (referred to as a cycle sewing machine hereinbelow) equipped with a cloth feeding mechanism in which a feed table having a cloth holding portion of the sewing machine where sewing needles are vertically moved is subjected to horizontal reciprocating movements in longitudinal directions i.e. back and forth directions of a bed of the sewing machine (referred to as X directions hereinbelow), and also, in directions intersecting at right angles with said longitudinal directions of the bed i.e. lateral directions (referred to as Y directions hereinbelow) so as to form bar tacking seams of the same size at two positions of a cloth or garment.

Figure 1:
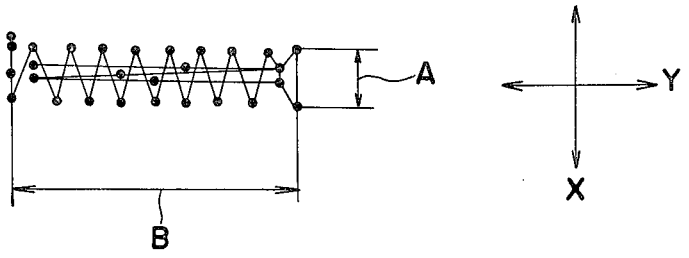

Conventionally, as a general bar tacking, there has been a zigzag chain stitch bar tacking seam as shown in a stitch work illustrated in FIG. 1, which is formed by a cycle sewing machine through formation of lateral stitches S1 and oblique stitches S2 for firmly stitching a cut piece or belt loop T to a garment G (FIG. 2), and has a seam width A within about 3 mm in the X direction and a seam length B within about 20 mm in the Y direction when finished.

The known cycle sewing machine of the above described type has been provided with a cloth feeding mechanism disclosed, for example, in Japanese Patent Publication Tokkosho No. 53-27660, and so arranged that a cloth feed table is reciprocated (longitudinal feeding) in the longitudinal direction of a bed, while said feed table is also subjected to an oscillating or rocking motion in a sector shape about a fixed axis, along a flat surface of the bed so as to displace a cloth holding portion of the feed table by a predetermined distance for the formation of seams.

Figure 2:
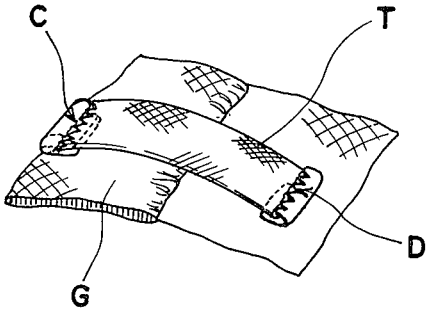

The known arrangement as described above, however, is not suitable for simultaneously forming similar two seams C and D in two portions, for example, at a waist portion G of trousers and the like by two sewing needles as in a belt loop sewing work shown in FIG. 2, because, in such a conventional arrangement, since the cloth feed table is arranged to oscillate or rock in the sector shape about the fixed axis along the flat surface of the bed, the seam sewn by the needle located farther from said fixed axis is formed to be longer in the lateral direction than the seam sewn by the needle located close to said first axis.

Therefore, in the conventional practice, for stitching the same seams at two positions of a garment, it has been necessary to sew two times, one portion at a time, respectively.

Moreover, as a needle thread cutting device of a type for cutting the needle thread at an upper surface of a cloth or garment after sewing the cloth by a cycle sewing machine, there has been proposed, for example, in Japanese Patent Publication Tokkosho No. 51-47109, an arrangement adopted for a button hole sewing, which is so arranged that a thread cutting shaft disposed approximately horizontally in parallel relation with a cloth depressing feed arm longitudinally provided on a bed of the sewing machine, is subjected to rotation and forward and backward movements through a roller and a lever engaged with a cam member operable by a control lever, so that thread cutting scissors confronting a retreated position at the side of a sewing needle are advanced from a forward end of the shaft towards the lower portion of the sewing needle for cutting the needle thread. In other words, the conventional needle thread cutting device as described above requires a transmission means including the roller and lever for transmitting the movement of the cam member to the thread cutting shaft, thus resulting in complication in construction of the device itself, while on the other hand, since it is necessary to hold the end of the cut off needle thread by the thread cutting scissors so as to release holding of the thread after sewing more than two to three stitches, upon starting of the subsequent sewing, the end of the needle thread at the start of sewing is undesirably drawn out of the upper surface of the cloth by more than 5 to 6 mm.

Meanwhile, there has also been conventionally proposed, for example, in Japanese Utility Model Publication Jikkosho No. 54-35808, a bobbin thread cutting device of a type having a reciprocating movable blade arranged to hook up the bobbin thread leading into a bobbin from a sewn cloth, through its advancing movement, and subsequently, to draw the bobbin thread thus hooked up towards a stationary blade through the returning movement of the movable blade for cutting off of said bobbin thread. However, since the known bobbin thread cutting device of the above described type is so constructed that the movable blade is mounted on a moving member movably provided for horizontal sliding movement along a guide rod of a fixed frame secured to the sewing machine bed, with said moving member being arranged to be reciprocated by an oscillating arm, a sliding mechanism including the fixed frame, guide rod, moving member, etc. is required for subjecting the movable blade to a linear horizontal displacement, thus also resulting in a complicated structure, with a consequent increase in the number of parts involved.

Accordingly, an essential object of the present invention is to provide a cycle sewing machine equipped with an improved cloth feeding mechanism, which is arranged to simultaneously form the same seams at two positions of a garment by twin needles in an efficient manner.

Another important object of the present invention is to provide a cycle sewing machine of the above described type, which is also provided with a needle thread cutting device of a simple construction, which is so arranged that, after sewing a garment, the needle threads leading to the sewing needles from the garment are drawn out by a necessary length through a thread draw-out device, while simultaneously, thread cutting scissors are advanced from a retreated position spaced from the needle position to a position close to the upper surface of the garment at the lower portions of the needles for cutting the needle threads at the same time.

A further object of the present invention is to provide a cycle sewing machine of the above described type, which is further provided with a bobbin or looper thread cutting device so arranged that, during cutting of the bobbin threads after sewing by the sewing machine, the bobbin threads are drawn out of the bobbins by a predetermined length so as to be cut off simultaneously, thereby to positively form seams without skipping of threads during starting of a subsequent sewing.

In accomplishing these and other objects, according to one preferred embodiment of the present invention, there is provided a cycle sewing machine having two needles movably disposed in a longitudinal direction thereof at a predetermined interval and equipped with a cloth feeding mechanism which comprises a cloth feeding cam driven for rotation at reduced speed in association with rotation of an arm shaft of the cycle sewing machine, and formed, at one side face and an outer peripheral surface thereof, with first and second cam grooves, a feed table horizontally movable in lateral directions (i.e. in Y directions) and longitudinal directions (i.e. in X directions) of said cycle sewing machine and fixed to a slide shaft so disposed between said cloth feeding cam and sewing needles of the cycle sewing machine as to be slidable in said lateral directions, with the feed table being arranged to be moved in said longitudinal directions by said first cam groove formed at the one side face of the cloth feeding cam through a first oscillating lever vertically provided on the cycle sewing machine, and to be moved in said lateral directions by said second cam groove provided in the outer peripheral surface of said cloth feeding cam through a second oscillating lever horizontally provided on the cycle sewing machine and a link member, and presser arms having presser feet at forward ends thereof, and supported, at rear ends thereof, by said feed table through a horizontal shaft. The presser feet are directed under said sewing needles by said presser arms, and respectively formed, in upper surfaces thereof, with countersink recesses in which lower ends of presser bars which can be properly depressed by cylinders are received. The presser bars are arranged to contact said presser feet by tension springs at all times.

By the arrangement according to the present invention as described above, an improved cycle sewing machine has been advantageously presented, with substantial elimination of disadvantages inherent in the conventional cycle sewing machines of this kind.

Figure 3:
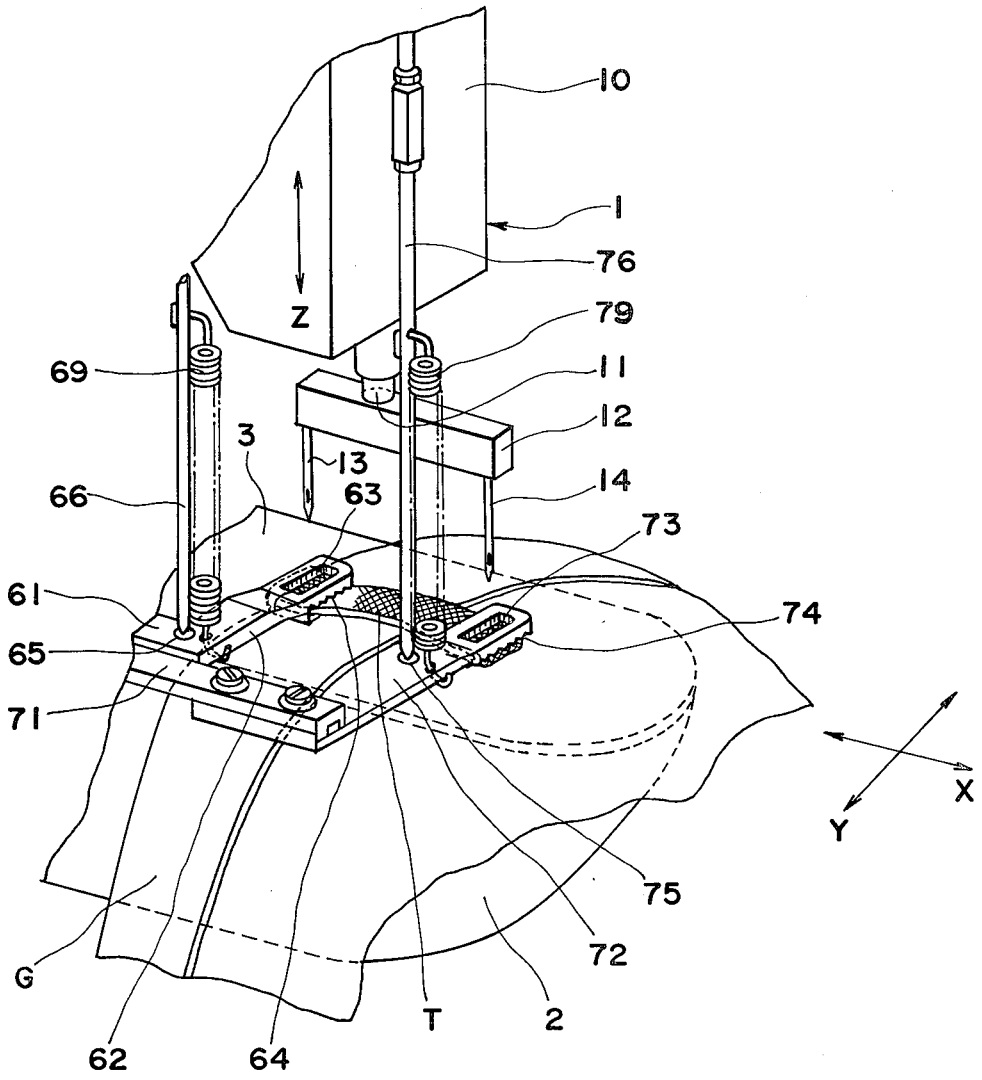
Figure 5:
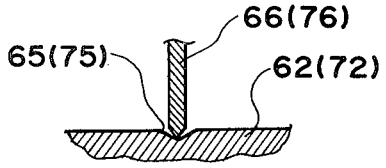
Figure 4:
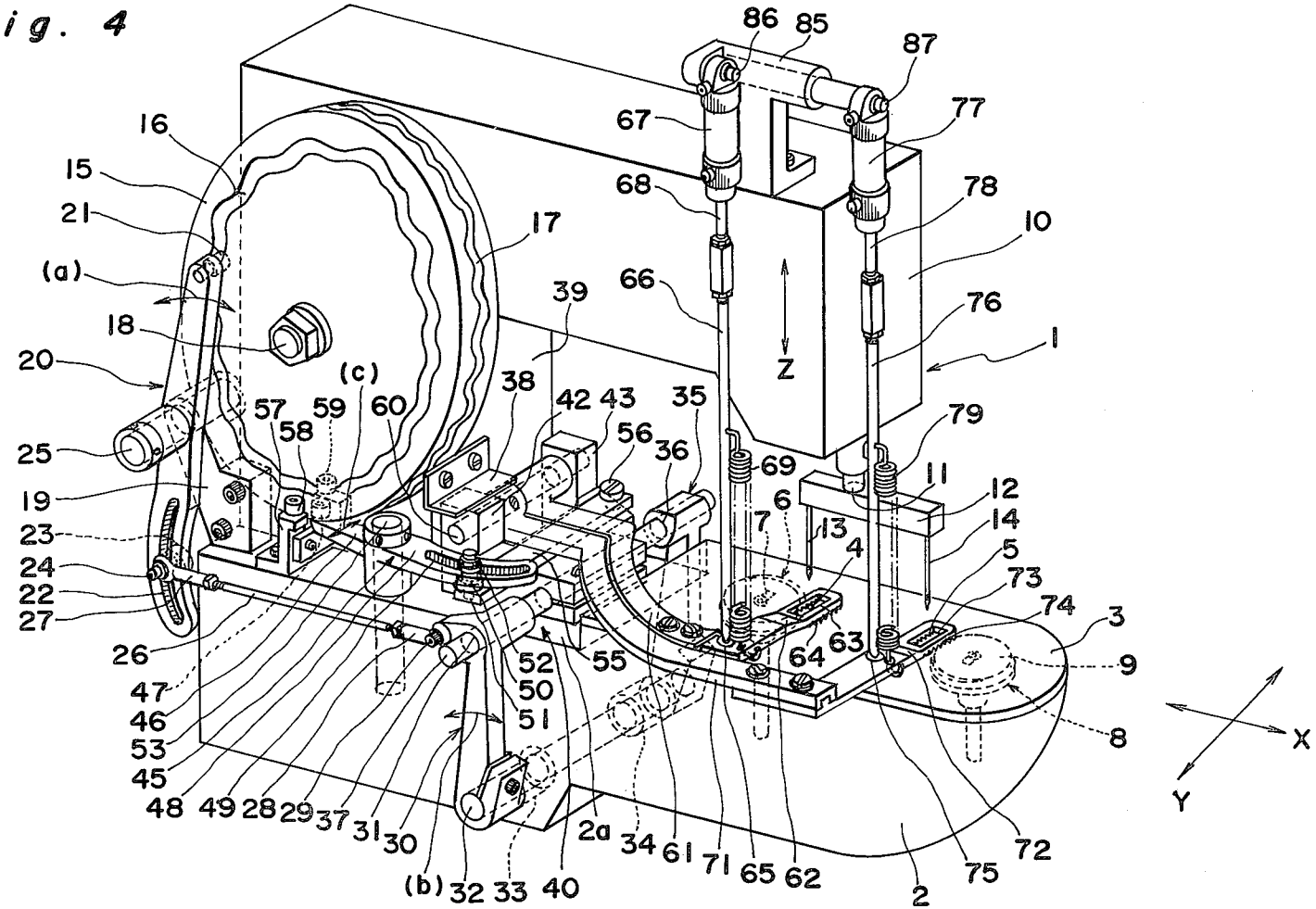
Figure 6:
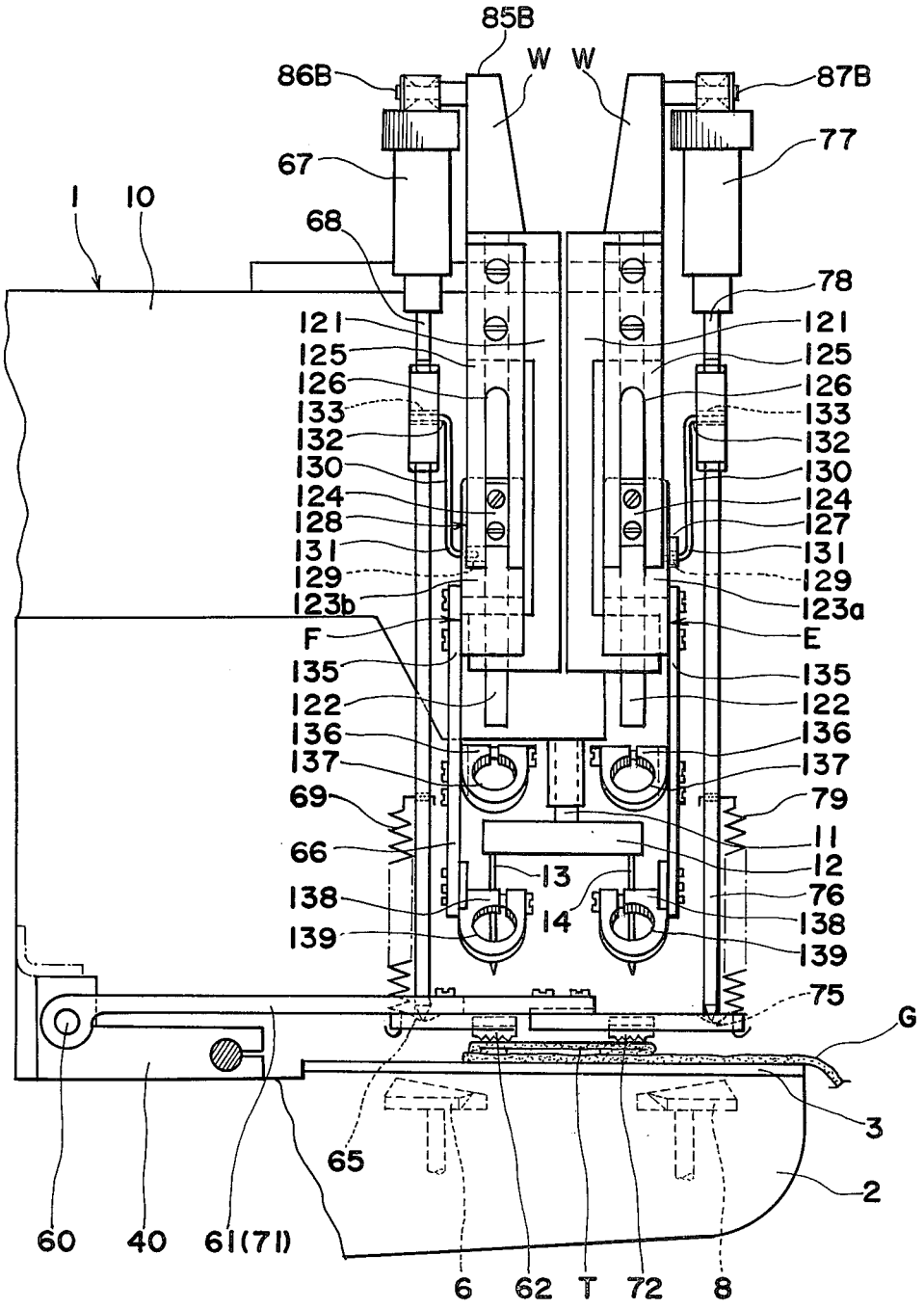
Figure 7:
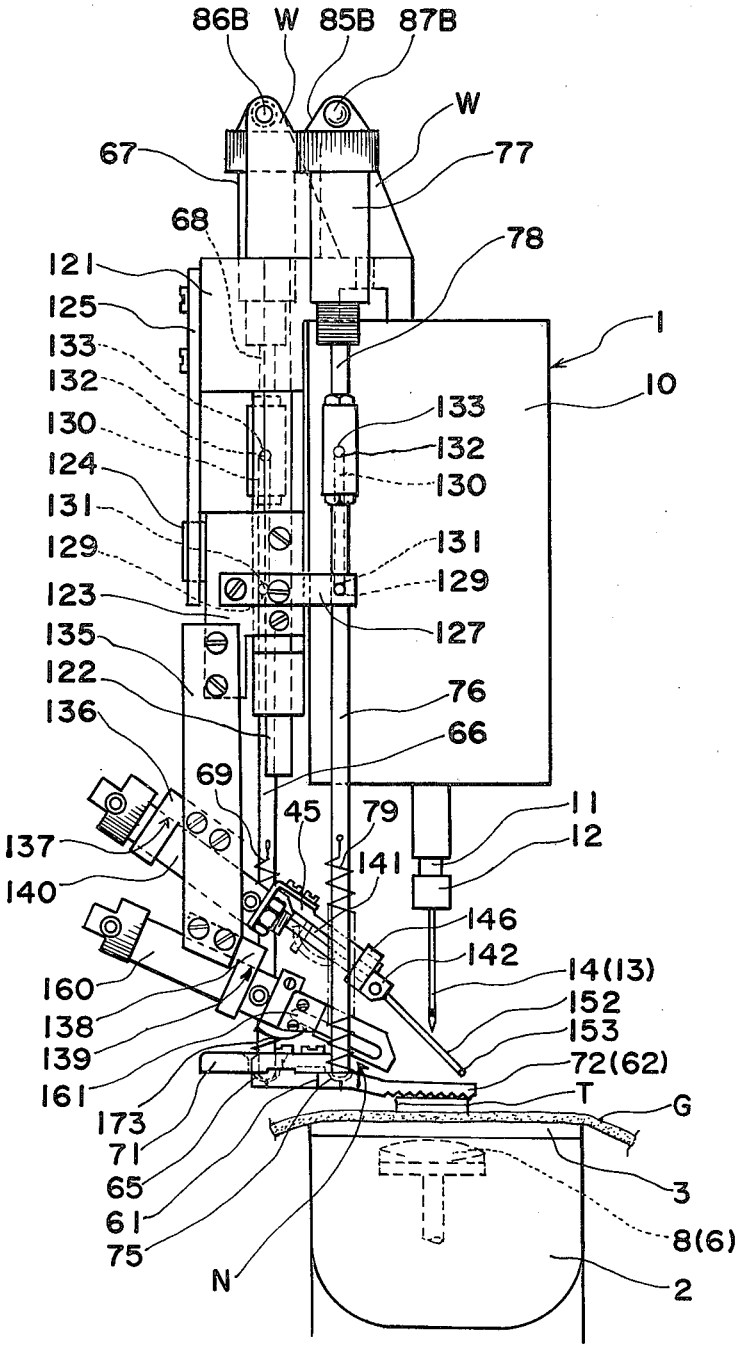
Figure 8A:
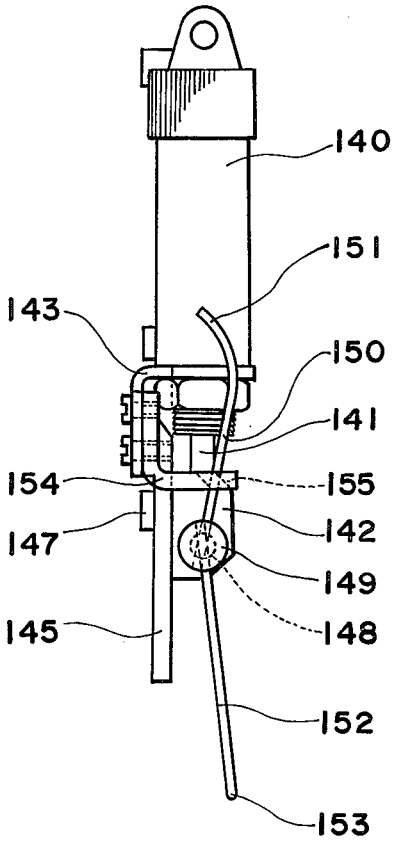
Figure 8B:
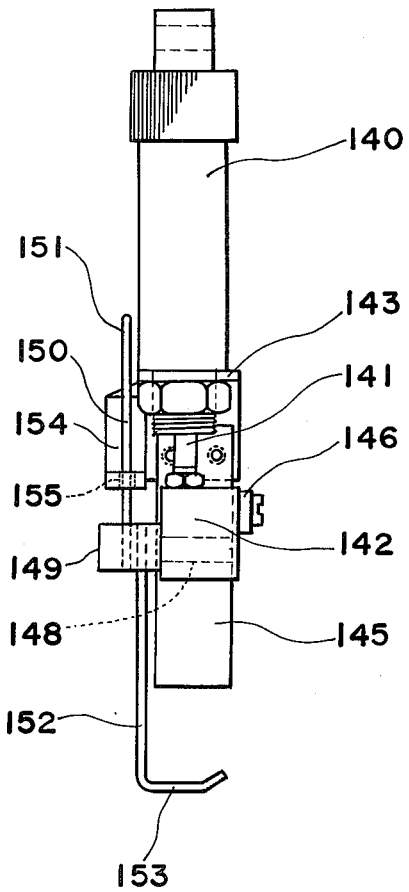
Figure 9A:
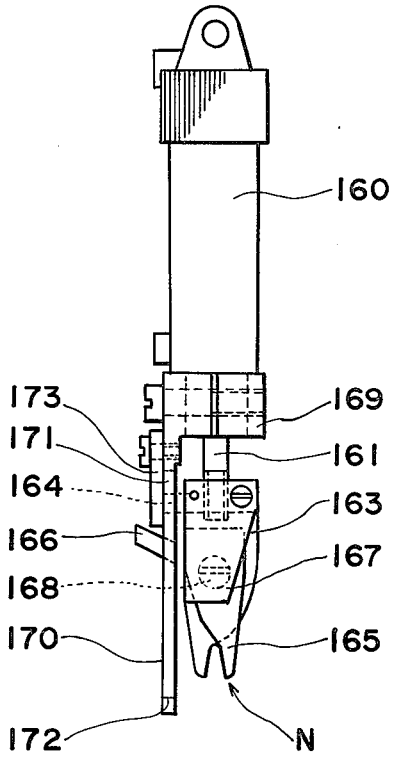
Figure 9B:
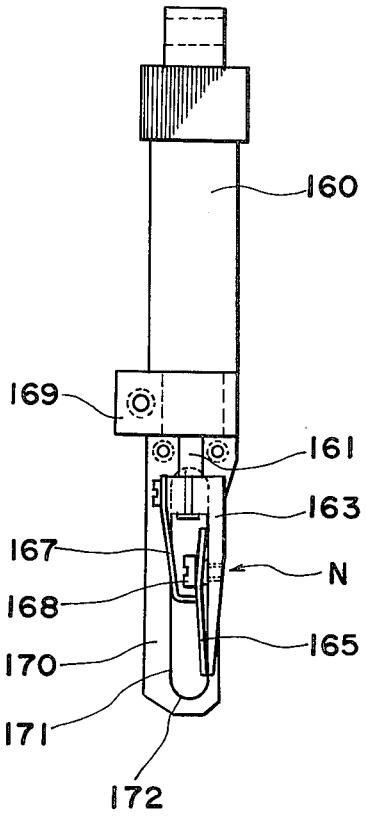
Figure 10:
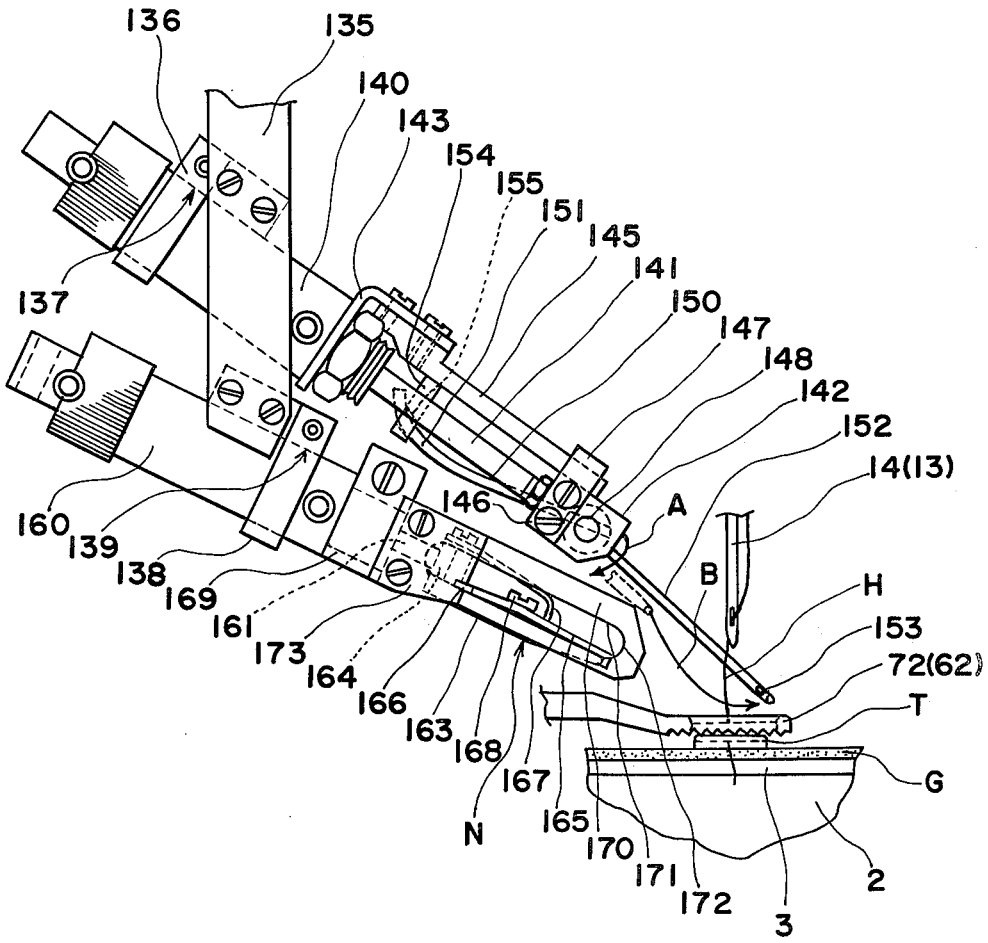
Figure 11:
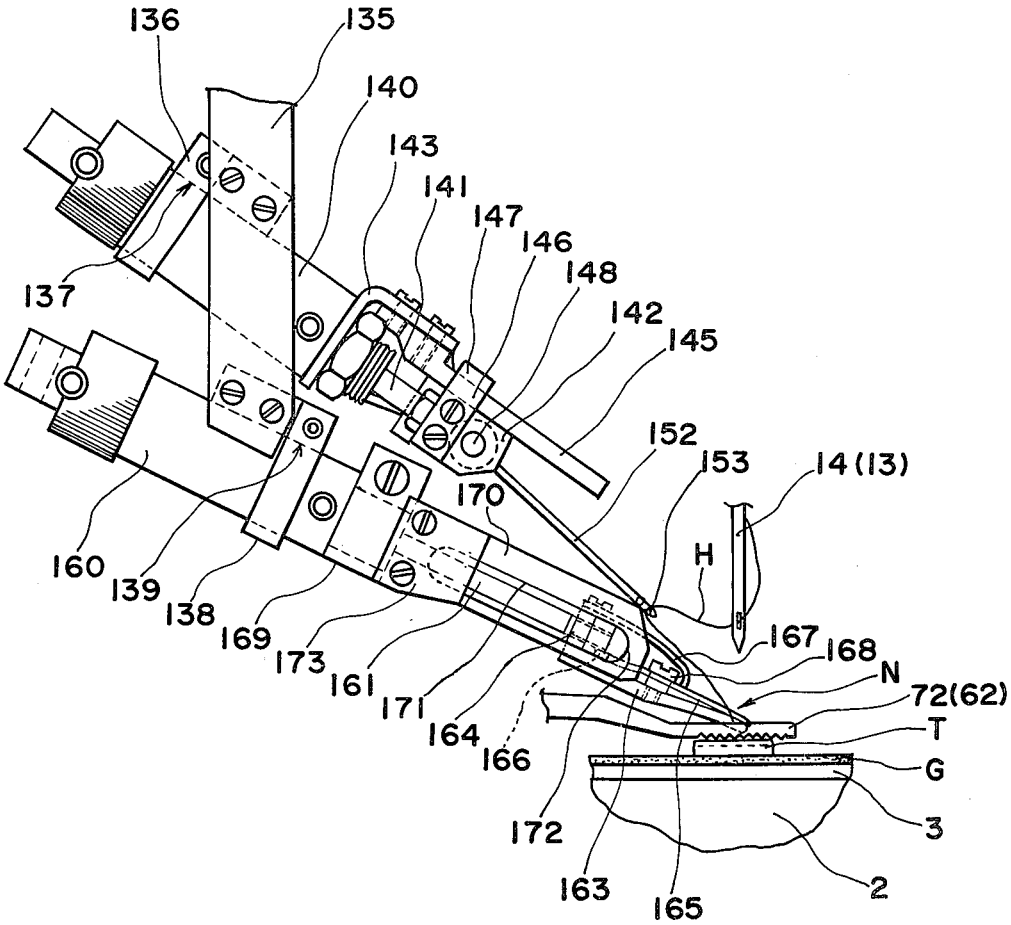
Figure 12:
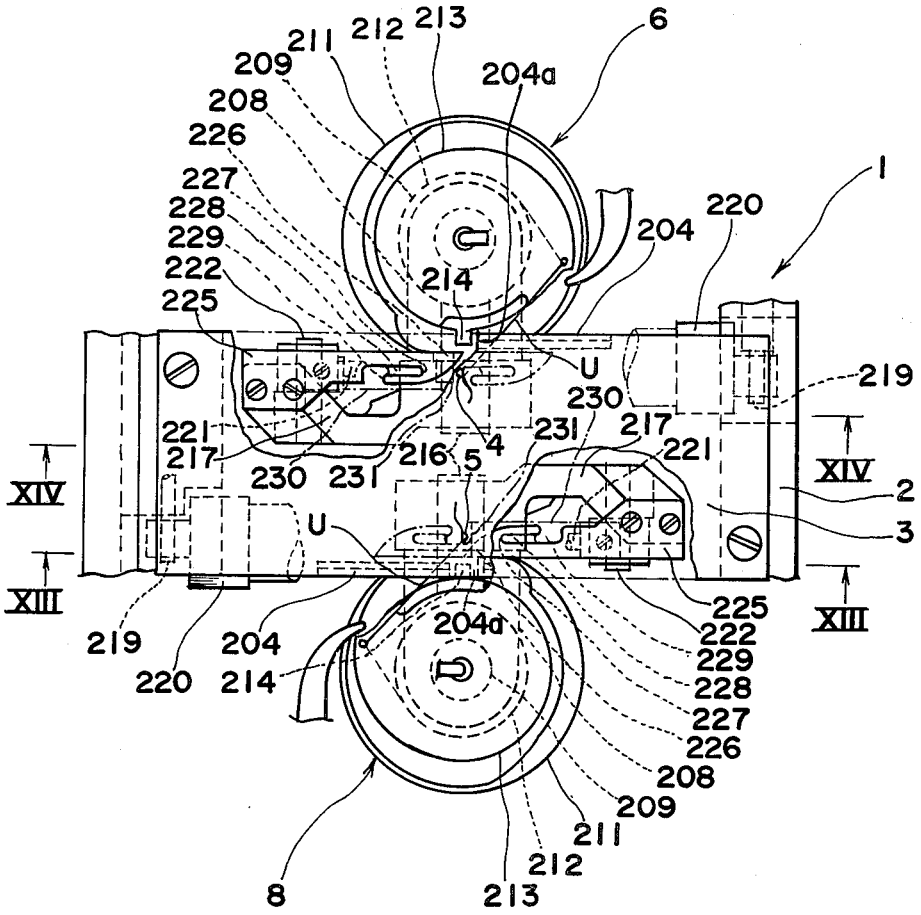
Figure 13:
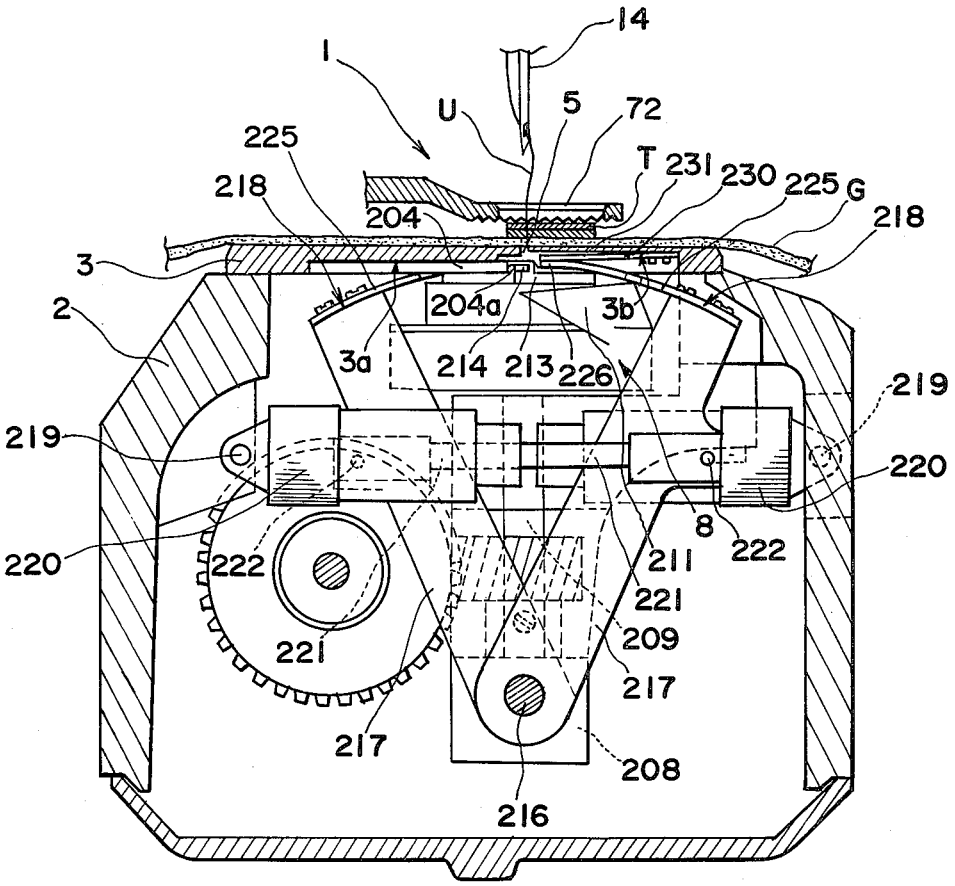
Figure 14:
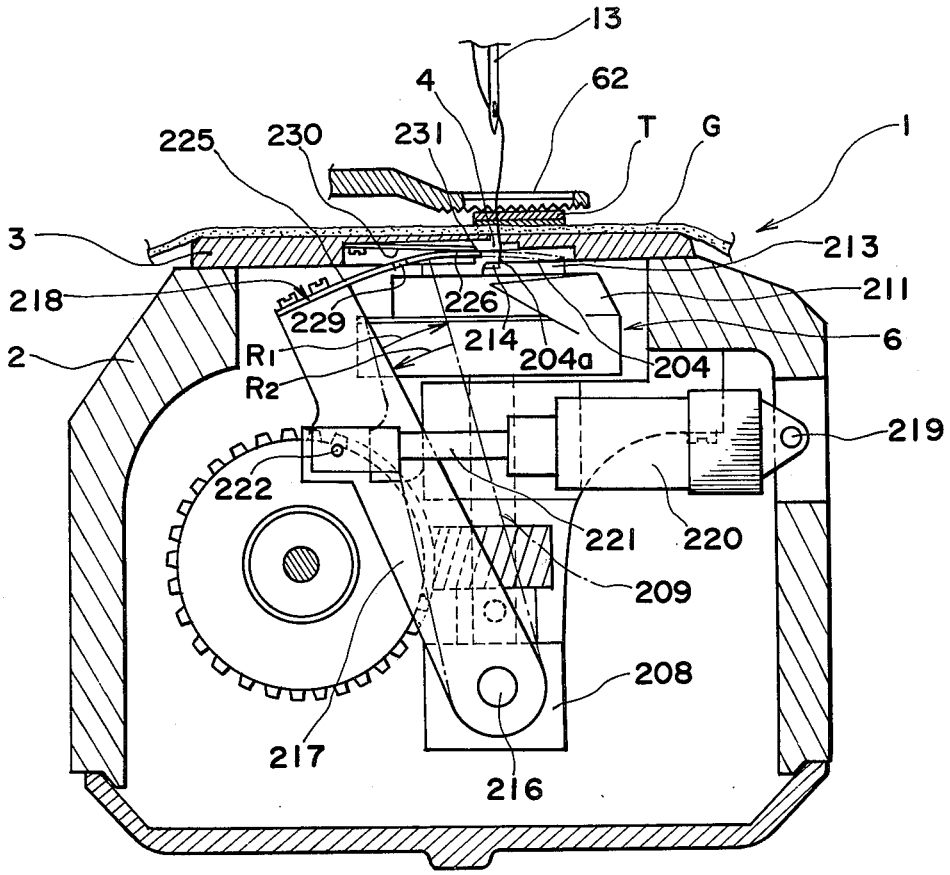
Figure 15:
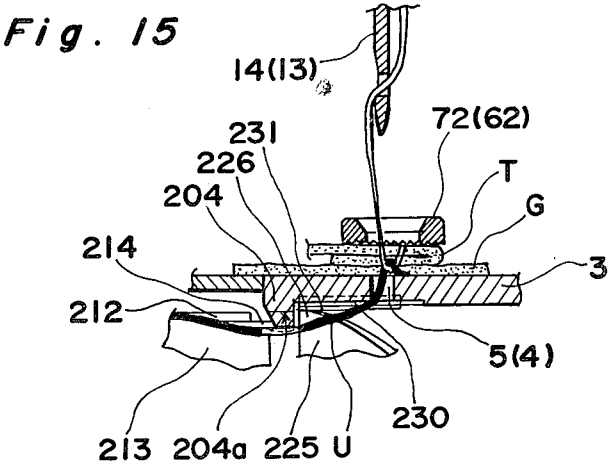
Figure 18:
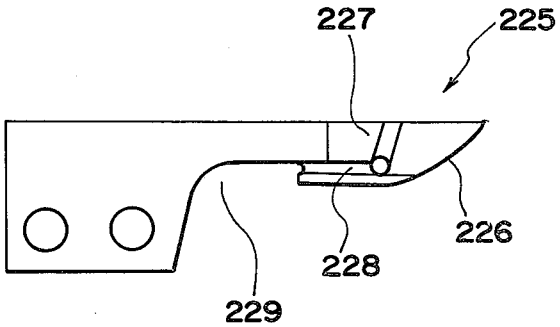

These and other objects and features of the present invention will become apparent from the following description taken in conjunction with the preferred embodiment thereof with reference to the accompanying drawings, in which;

FIG. 1 is a diagram explanatory of a stitch work by a sewing needle in a cycle sewing machine (already referred to), FIG. 2 is a fragmentary perspective view showing a state where a cut piece is sewn to a waist portion of a garment in the form of a belt loop (already referred to), FIG. 3 is a fragmentary perspective view of a cycle sewing machine according to one preferred embodiment of the present invention in which a cloth holding portion holds the cut piece folded back at its opposite ends, together with the waist portion of the garment, FIG. 4 is an overall perspective view of the cycle sewing machine of FIG. 3 equipped with a cloth feed mechanism of the present invention, FIG. 5 is a fragmentary side sectional view showing a state where a lower end of a presser bar is received in a countersink recess formed in a presser foot employed in the arrangement of FIG. 4, FIG. 6 is a fragmentary side sectional view at a front portion (i.e. at the right side) of the cycle sewing machine of FIG. 4 which is further equipped with a needle thread cutting device according to the present invention, FIG. 7 is a front elevational view of the portion of FIG. 6, FIG. 8(*a*) is a rear side view of a thread draw-out device employed in the arrangement of FIG. 7, FIG. 8(*b*) is a side elevational view of the thread draw-out device of FIG. 8(*a*), FIG. 9(*a*) is a front elevational view of a thread cutting scissor device employed in the arrangement of FIG. 7, FIG. 9(*b*) is a rear side view of the thread cutting scissor device of FIG. 9(*a*), FIGS. 10 and 11 are fragmentary side elevational views explanatory of functionings of the thread cutting scissor device and thread draw-out device of FIG. 8(*a*) to FIG. 9(*b*), FIG. 12 is a fragmentary top plan view showing a state where a bobbin thread cutting device of the present invention is further incorporated into the bed of the cycle sewing machine of FIG. 4, FIG. 13 is a cross section taken along the line XIII—XIII in FIG. 12, FIG. 14 is a cross section taken along the line XIV—XIV in FIG. 12, FIGS. 15, 16 and 17 are fragmentary cross sectional diagrams explanatory of functionings of a movable blade employed in the bobbin thread cutting device of FIG. 12, FIG. 18 is a top plan view of a movable blade employed in the bobbin thread cutting device of FIGS. 12 to 14, and FIG. 19 is a flow-chart explanatory of sequence of functionings of the cycle sewing machine according to the present invention described with reference to FIGS. 3 to 17.

Before the description of the present invention proceeds, it is to be noted that like parts are designated by like reference numerals throughout the accompanying drawings.

Referring now to the drawings, there is shown, in FIGS. 3 and 4, a cycle sewing machine 1 to which the present invention may be applied. The sewing machine 1 is generally so constructed that a throat plate 3 disposed on a horizontal surface of a sewing machine bed 2 is provided with two needle holes 4 and 5 separately formed along the longitudinal direction or back and forth direction of the bed 2 (i.e. in the X directions), and, adjacent to the under surface of the throat plate 3 in positions at the outer sides in the back and forth direction of the two needle holes 4 and 5, there are provided horizontally rotating shuttles 6 and 8 for receiving bobbins 7 and 9 therein so as to be located close to said needle holes 4 and 5 respectively, while, at opposite ends of a needle base 12 secured to a needle bar 11 for a sewing machine arm 10, two needles 13 and 14 are provided to correspond to the needle holes 4 and 5 of the throat plate 3 described above, so that seams are formed simultaneously at two positions via vertical movements of the needles 13 and 14 through the needle holes 4 and 5 with associated rotation of the horizontally rotating shuttles 6 and 8 with respect to said needles 13 and 14 at the same time.

More specifically, as shown in FIG. 4, the cycle sewing machine 1 (referred to merely as a sewing machine hereinbelow) having the two needles 13 and 14 includes a cloth feeding cam 15 of a disc-like configuration having a cam groove 16 formed in a zigzag manner at its one side face adjacent to a peripheral edge thereof, and another cam groove 17 also formed in a zigzag manner in its peripheral surface as shown, and rotatably mounted at the rear portion of the sewing machine 1 through a cam shaft 18 for rotation at a reduced speed in association with rotation of an arm shaft (not particularly shown) of the sewing machine 1, an oscillating or rocking lever 20 with vertically extending arms disposed at a rear side portion of the cloth feeding cam 15 and pivotally supported by a support base 19 secured to the rear lower portion of the sewing machine arm 10, through a horizontally extending shaft 25. At the end of the one upwardly extending arm of said oscillating lever 20, there is provided a cam roller 21, which is rotatably received in said cam groove 16 formed in the side face of the cloth feeding cam 15, while the other downwardly extending arm of the oscillating lever 20 is formed, along its longitudinal direction, with an arcuate elongated through-opening 22, in which a stepped nut 23 is slidably and adjustably received. To the end of the stepped nut 23, a rear end of a connecting rod 26 which is disposed in the longitudinal direction in parallel relation with the side face of the sewing machine arm 10, is connected by a screw 24 through a side bearing 27. On the other hand, the forward end of the above connecting rod 26 is fixed by a screw 29 to the rear side at the upper end of an oscillating arm 30 provided in an erected state at the side face of the bed 2, through a slide bearing 28, while the lower end of said oscillating arm 30 is screwed to one projecting end of a rotary shaft 32 provided in bearings 33 and 34 at a lower parallel portion of the bed 2 so as to be parallel to the horizontal upper surface 2*a* of the bed 2 and directed in a direction intersecting at right angles with the longitudinal direction or back and forth direction of the bed 2 (i.e. in the Y direction).

Moreover, to the other end of the rotary shaft 32 extending outwardly from the other side face of the bed 2, another oscillating arm 35 is fixed in an erected state, with the bearings 33 and 34 being held between the oscillating arms 30 and 35 so as to prevent swaying in the axial direction for oscillation of the arm 35 in association with said oscillating arm 30. Furthermore, at the upper ends of both of the oscillating arms 30 and 35, through-openings 31 and 36 aligned with an axis parallel to the rotary shaft 32 are respectively formed for slidably receiving therein a side shaft 37.

To a central portion of the slide shaft 37 located between the through-openings 31 and 36 as described above, there is fixed a feed table 40 having bearing portions 42 and 43 projecting upwardly in a bifurcated configuration from its rear portion. The feed table 40 is slidably mounted on a horizontal upper surface 2*a* of the bed 2, while the upper surface of the bearing potion 42 thereof is arranged to slidably contact the upper surface of an L-shaped guide plate 38 fixed to a wall 39 formed at a lower inner portion of the arm 10, whereby the feed table 40 is horizontally movable in the directions of its axis (i.e. in the Y directions) together with the slide shaft 37, while being guided by the guide plate 38 over the horizontal upper surface 2*a* of the bed 2, and also in the longitudinal directions of the bed 2 (i.e. in the X directions) through a small degree of oscillation or rocking of the oscillating arms 30 and 35.

More specifically, the distance from the rotary shaft 32 for the oscillating arms 30 and 35, to the sliding through-openings 31 and 36 is set at approximately 70 mm in this embodiment, while said openings 31 and 36 for the oscillating arms 30 and 35 are so controlled by the cam 15 as to oscillate by 3 mm at the maximum about the rotary shaft 32 in the embodiment described so far, with a consequent arcuate movement of the slide shaft 37 for 3 mm in the X directions or longitudinal directions of the bed 2. However, the amount of vertical displacement of the slide shaft 37 with respect to the horizontal upper surface 2*a* of the bed 2 by the above arcuate movement is limited to only about 0.02 mm, thus presenting no particular mechanical obstruction for the feed table 40 fixed to the slide shaft 37, to move by 3 mm over the horizontal upper surface 2*a* of the bed 2. Accordingly, by the oscillation of the oscillating arms 30 and 35 to a small degree as described above, the feed table 40 may be horizontally moved in the X directions or longitudinal directions of the bed 2.

On the other hand, below the outer peripheral surface of the cam 15, there is disposed another oscillating lever 45 for lateral feeding, having arms extending back and forth in the longitudinal direction of the bed 2. The oscillating lever 45 is rotatably supported on the horizontal surface 2*a* of the bed 2 through a vertical shaft 53 for horizontal rotation, and a rear arm 46 of the lever 45 extending up to a position immediately below the outer peripheral surface of the cam 15 is provided with a cam roller 47 at its end portion, with said cam roller 47 being rotatably received in the cam groove 17 formed in the outer peripheral surface of said cam 15. Meanwhile, the forward arm 48 of the oscillating lever 45 extending up to the side portion of the feed table 40 is formed, in its forward half portion, with an arcuate elongated through-opening 49 in the longitudinal direction. In the above elongated through-opening 49, a stopped screw 50 having a flange portion and a depending shaft 51 at its lower portion is slidably and adjustably received, while the stepped screw 50 is adapted to be fixed at a desired position within the through-opening 49 by a nut 52. To the depending shaft 51 of the stepped screw 50, one end of a plate-like link 55 disposed generally in parallel relation with respect to the slide shaft 37 is pivotally connected, while the other end of the link 55 is pivotally connected to the side portion on the upper surface of the feed table 40 by a stepped screw 56.

Furthermore, to the upper ends of a bifurcated support base 57 secured to the horizontal upper surface 2*a* of the bed 2 in a position below the cam 15, guide rollers 58 and 59 are mounted to contact the opposite side faces of the cam 15 in a position where the cam roller 47 of the oscillating lever 45 is inserted into the groove 17 of said cam 15 so as to prevent swaying of the cam 15 due to a force exerted in the axial direction of the cam shaft 18 during movement of the cam roller 47 within the cam groove 17 in the zigzag configuration through rotation of the cam 15.

Meanwhile, on a horizontal shaft 60 rotatably received by the bearing portions 42 and 43 of the feed table 40, rear ends of two long presser arms 61 and 71 disposed in parallel relation to each other in the longitudinal direction of the bed 2 are pivotally supported for independent pivotal movement. Both of the presser arms 61 and 71 generally horizontally extend forwardly from the rear portions thereof through the upper portion of the feed table 40, and thereafter, further extend up to side portions of the two needles 13 and 14 arranged in the longitudinal direction of the sewing machine 1, by detouring towards the side of the bed 2 for avoiding the upper portion of the horizontally rotating shuttle 6 so as not to obstruct withdrawal and insertion of the bobbin 7, with presser feet 62 and 72 being fixed to the forward ends of the presser arms 61 and 71 for depressing of the cloth to be sewn. The presser feet 62 and 72 extend up to positions immediately below the needles 13 and 14 generally in parallel relation to each other, and are provided with elongated through-openings 63 and 73 formed in the forward ends thereof to correspond to the two needle holes 4 and 5 provided in the throat plate 3, and also, with notches or nicks 64 and 74 formed at their under surfaces for preventing slippage of the garment to be sewn.

Furthermore, in the upper surfaces of the presser feet 62 and 72, there are respectively formed countersink recesses 65 and 75, into which conical lower ends of presser bars 66 and 76 respectively provided independently at the side portion and front side of the arm 10 for vertical movements in directions indicated by arrows Z, are received, while upper ends of the presser bars 66 and 76 are fixed to corresponding ends of piston rods 68 and 78 of depending cylinders 67 and 77 which are respectively supported independently by pivotal shafts 86 and 87 provided at a side portion and a front and of an L-shaped base 85 secured on the upper surface of the arm 10.

It is to be noted here that, in this embodiment, length of the presser bars 66 and 76 between the pivotal shafts 86 and 87 and the lower ends thereof is set at approximately 280 mm, with said conical lower ends of the presser bars 66 and 76 being arranged to be raised by about 15 mm by the cylinders 67 and 77.

Moreover, the presser bars 66 and 76 are respectively coupled to the presser feet 62 and 72 through tension springs 69 and 79, by the action of which springs 69 and 79, the presser feet 62 and 72 normally contact the conical lower ends of the presser bars 66 and 76, and, following rising of the presser bars 66 and 76 in a vertical direction, are simultaneously raised up to a position at the height of 15 mm above the upper surface of the throat plate 3. As shown in the cross section of FIG. 5, the countersink recesses 65 and 75 of the presser feet 62 and 72 are each formed to have an angle larger than an angle for the taper at the conical lower ends of the presser bars 66 and 76, by which arrangement, even when the presser feet 62 and 72 are horizontally moved through rotation of the cam 15, the conical ends of the presser bars 66 and 76 are subjected to point contact with corresponding bottom portions of the countersink recesses 65 and 75 at all times so that the smooth horizontal movement of the presser feet 62 and 72 are not obstructed even upon depression of these presser feet 62 and 72 by the action of the depending cylinders 67 and 77.

Figure 19:
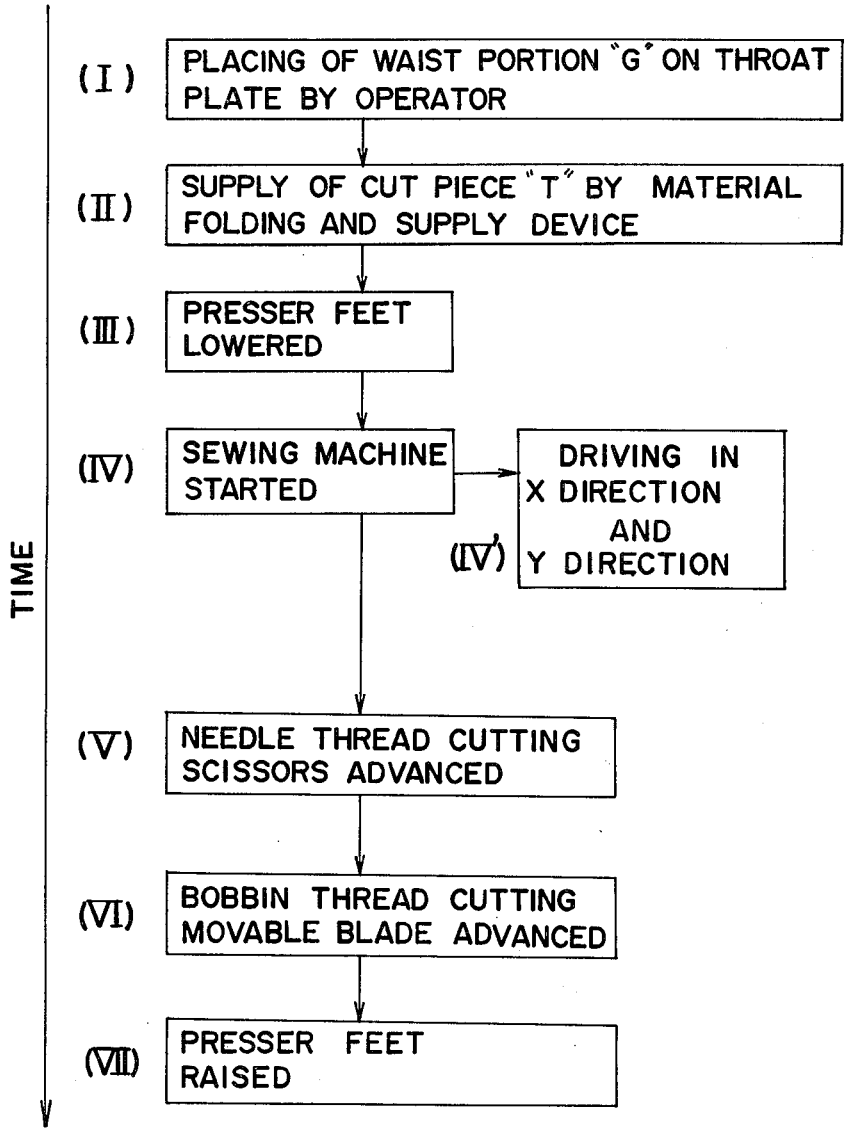

Functionings of the cycle sewing machine according to the presser invention having the construction as described so far will be explained hereinbelow based on a flow-chart of FIG. 19 with reference to a case, for example, where it is applied to a sewing machine exclusive for sewing of belt loops.

As shown in FIG. 3, upon turning ON of a start switch (not particularly shown), with the waist portion G of a pair of trousers, slacks, etc., placed on the throat plate 3 of the sewing machine 1 by an operator (step (I)), a material holding and supplying device (not shown) for belt loop formation is actuated, and supplies cut pieces T of the material each having folded end portions folded over at an angle of 180° on opposite ends thereof so that said opposite ends are brought into positions immediately below the presser feet 62 and 72 independently provided at the front and rear portions as shown (step (II)).

In the above state, the piston rods 68 and 78 of the depending cylinders 67 and 77 as shown in FIG. 4 are simultaneously advanced so as to lower the presser feet 62 and 72 through the presser bars 66 and 76 for depression of the folded portions at the opposite ends of the cut pieces T together with the waist portion G of the trousers, etc. (step (III)).

Subsequently, the sewing machine 1 is started to actuate the needle bar 11 and the horizontally rotating shuttles 6 and 8, and also, to rotate the cloth feed cam 15 at the rear side (step (IV)), whereby the oscillating lever 20 is rocked in the directions indicated by arrows (a) in FIG. 4 about the horizontal shaft 25 along the cam groove 16, through the cam roller 21 received in the said cam groove 16 formed in the side face of the cam 15, and accordingly, the oscillating arms 30 and 35 are oscillated in the directions indicated by arrows (b) about the rotary shaft 32 through the connecting rod 26, with simultaneous similar oscillation of the slide shaft 37. Consequently, the cloth feed table 40 is horizontally moved in the X directions or longitudinal direction of the bed 2 so as to simultaneously displace the presser arms 61 and 71 and presser feet 62 and 72 for horizontally moving the cut piece T and the waist portion G of the trousers depressed by the presser feet 62 and 72 through the presser bars 66 and 76 in the X direction with respect to the needles 13 and 14 (step (IV')).

In the above state, there are cases where the presser bars 66 and 76 and depending cylinders 67 and 77 are rocked in the longitudinal direction (X direction) of the bed 2 about the shafts 86 and 87 through horizontal movement of the presser feet 62 and 72 so as to depress the presser feet 62 and 72 in a state slightly inclined slantwise, but since the angle of such inclination is about 18 minutes at the maximum with respect to the vertical direction, the lateral depressing force by the presser bars in the inclined state with respect to the lateral movement of the presser feet 62 and 72 is so small that it provides no obstruction to the smooth operation.

Additionally, for adjsuting the longitudinal feeding amount of the feeding table 40 with respect to the needles 13 and 14, i.e. the amount of displacement of the feed table 40 in the X direction to a desired extent, the stepped nut 23 and slide bearing 27 may be displaced by a required degree along the elongated opening 22 with the screw 24 loosened, for subsequent re-tightening of said screw 24 after the adjustment.

On the other hand, through rotation of the cloth feeding cam 15, the oscillating lever 45 is horizontally moved in the directions indicated by arrows (c) about the vertical shaft 53 through the cam roller 47 received in the cam groove 17 formed in the outer peripheral surface of said cam 15 so as to laterally push and pull the plate-like link 55 for horizontally moving the cloth feed table 40 in the Y directions or lateral directions together with the slide shaft 37 along the through-openings 31 and 36 of the oscillating arms 30 and 35, whereby the presser arms 61 and 71 and presser feet 62 and 72 are moved so as to horizontally displace the cut piece T and the waist portion G of the trousers and the like depressed by said presser feet 62 and 72 through the presser bars 66 and 76, in the Y directions or in the direction intersecting at right angles with the longitudinal direction of the bed 2 with respect to the needles 13 and 14 (step (IV')).

In the above state, there are cases where the presser bars 66 and 76 and depending cylinders 67 and 77 are rocked in the directions intersecting at right angles with the longitudinal direction of the bed 2, i.e. in the Y direction so as to depress the presser feet 62 and 72 in a state slightly inclined slantwise, but since the angle of such inclination is about 2 minutes at the maximum with respect to the vertical direction, the lateral depressing force by the presser bars 66 and 76 in the inclined state with respect to the lateral movement of the presser feet 62 and 72 is so small that it provides no obstruction.

Moreover, for adjusting the lateral feeding amount with respect to the needles 13 and 14, i.e. the amount of displacement of the feed table 40 in the directions intersecting at right angles with the longitudinal direction of the bed 2 i.e. in the Y direction, to a desired level, the stepped nut 50 with the flange may be displaced by a required degree together with the plate-like link 55 along the elongated opening 49 with the nut 52 loosened, for subsequent re-tightening of said nut 52 after the adjustment.

After completion of the sewing in the above described manner, the presser feet 62 and 72 are raised to release the waist portion G and cut pieces T from depression (step (VIII)).

It should be noted here that in the foregoing embodiment, although the present invention has been mainly described with reference to the cycle sewing machine provided with twin needles, the present invention is not limited, in its application, to the sewing machine having twin needles alone, but may readily be applied to cycle sewing machines having a single needle.

As is clear from the foregoing description, according to the embodiment of the present invention described so far, through oscillation control of the oscillating levers 20 and 45 by the cloth feeding cam 15 via the cam rollers 21 and 47, the feed table 40 is displaced in the longitudinal directions of the bed 2 (i.e. in the X directions) or in the directions intersecting at right angles with the longitudinal directions of the bed 2 (i.e. in the Y directions), while by the composite movements as described above, the garment to be sewn is moved as desired with respect to the sewing positions for the two needles 13 and 14 vertically moving at predetermined positions, and thus, it has been made possible to simultaneously form the same seams at two positions of the garment.

Moreover, according to the foregoing embodiment of the present invention, since it is so arranged that, particularly for the horizontal movement of the feed table 40 in the Y directions, the cam groove 17 is formed in the outer peripheral surface of the cloth feed cam 15 for engagement, at the lower surface of the cam 15, with the cam roller 47 provided at one end of the oscillating lever 45 capable of horizontal oscillation so as to horizontally move said cam roller 47 for directly transmitting the movement of the cam roller to the other end of the oscillating lever 45, thereby to directly move the feed table 40, there is no necessity for providing an L-shaped driving arm or the like for converting the movement of an oscillating arm which oscillates in the vertical direction in association with the cloth feed cam, into an oscillating movement in the horizontal direction as in the conventional arrangements. Accordingly, the arrangement of the present invention having the small number of parts involved for connecting means, with a consequent simple construction, has a prolonged durability and can be produced at low cost. Moreover, owing to the arrangement that the raising and lowering of the presser feet 62 and 72 may be effected by the two cylinders and two piston rods, while the depressing force can be readily applied directly to the presser feet 62 and 72 by said two cylinders and two piston rods, no undue resistance is applied to the cloth feeding mechanism, with a consequent prolonged service life.

Referring now to FIGS. 6 through 11, a needle thread cutting device according to the present invention, which may be further applied to the cycle sewing machine explained in the foregoing embodiment of FIGS. 3 to 5, will be described hereinbelow. Since the cycle sewing machine 1 to be employed for the embodiment of FIGS. 6 through 11 may generally have the same constructions and functions as those in FIGS. 3 to 5 except for the inclusion of the novel needle thread cutting device to be described below, and except for replacement of the L-shaped base 85 fixed on the upper surface of the sewing machine arm 10 for pivotally supporting the cylinders 67 and 77 in FIGS. 3 to 5, by a modified support base 85B, detailed description thereof is abbreviated for brevity, with like parts being designated by like reference numerals. In the embodiment of FIGS. 6 to 11, the modified support base 85B has a pair of spaced support stands W and is secured on the upper surface of the sewing arm 10 for supporting the depending cylinders 67 and 77 through the pivotal shafts 86B and 87B respectively provided on said stands W in the similar manner as in the arrangement of FIGS. 3 to 5.

As shown in FIGS. 6 and 7, the needle thread cutting device includes generally U-shaped bearings 121 provided at edge portions of the support stands W for the support base 85B in an erected state, along the side portion of the sewing machine arm 10, and slide shafts 122 vertically received in said bearings 121. To the central portion of each of the slide shafts 122, a block-like moving piece **123*a* or 123*b* is fixed, while guide pieces 124 are secured to side faces of the respective moving pieces 123*a* and 123*b*. The guide pieces 124 thus fixed to the moving pieces 123*a* and 123*b* are slidably received for vertical movement within corresponding elongated grooves 126 formed in lower half portions of erected plates 125 secured to the upper side faces of said bearings 121, in a parallel relation with the slide shafts 122 so as to retain said slide shafts 122** from rotation.

Meanwhile, in a connecting plate 127 provided at the front side of the front moving piece **123*a* and also, in the back face side 128 of the rear moving piece 123*b*, there are respectively formed horizontal openings 129 directed in the longitudinal direction of the arm 10, into which openings 129, horizontal pin portions 131 formed at lower ends of connecting metal pieces 130 bent into hook-like configuration at opposite ends thereof, are rotatably inserted, while the other horizontal pin portions 132 formed at upper ends of said metal pieces 130 are rotatably received in corresponding horizontal openings 133 formed in the upper portions of the presser bars 66 and 76 in a direction parallel to said horizontal openings 129 of said moving pieces 123*a* and 123*b*, whereby the two moving pieces 123 are arranged to be independently movable in the vertical directions in association with the vertical movements of said presser bars 66 and 76**.

Moreover, to a front face E and a rear face F at the lower portions of the respective moving pieces **123*a* and 123*b*, upper portions of vertical plates 135 are secured so as to be depending therefrom towards the side portions of the two needles 13 and 14, while, to the central portions and lower end portions of said vertical plates 135, there are secured a pair of holding rings 136 and another pair of holding rings 138 respectively formed with split embracing holes 137 and 139. Moreover, in the split holes 137 for the upper holding pieces 136, piston cylinders 140 having forward ends thereof corresponding to the two needles 13 and 14 are fixedly embraced through clamping by screws as shown in FIG. 7**.

Meanwhile, as shown in FIGS. 8(*a*) and 8(*b*), to the forward ends of piston rods 141 for the cylinders 140, there are fixed lead pieces 142 in the form of blocks, the upper surfaces of which lead pieces 142 are arranged to slidably contact the lower surfaces of guide plates 145 which are secured, in parallel relation with the piston rods 141, to L-shaped members 143 clamped to the forward ends of the piston cylinders 140 by nuts, while the lower surfaces of horizontal portions 147 of another set of L-shaped guide plates 146 fixed to side faces of said lead pieces 142 are adapted to slidably contact the upper faces of the guide plates 145 for preventing the piston rods 141 from rotation.

Furthermore, in the lead pieces 142 as referred to above, horizontal shafts 148 are rotatably provided in a direction intersecting at right angles with axes of the piston rods 141. To projecting ends 149 of said horizontal shafts 148, there are fixed lower ends of guide rods 150 each having upper half portions bent in an arcuate configuration as at 151, and also, upper ends of thread draw-out rods 152 each having lower end portions bent in a hook-like shape as at 153 in a horizontal direction. The upper portions of the guide rods 150 are respectively slidably received in sliding through-openings 155 formed in L-shaped support pieces 154 secured to the L-shaped members 143, in a direction intersecting at right angles with the horizontal shafts 148 and at positions lower than the axes thereof by about 2 mm.

The piston cylinders 140 for drawing out the needle threads respectively fixed in the pair of holding rings 136 as described earlier, are each so positioned that, upon protrusion of the piston rods 141 thereof, the horizontal hook-like portions 153 of the thread draw-out rods 152 provided at the ends of the piston rods 141, first move slantwise downwardly to positions prior to the positions immediately below the two needles 13 and 14 as shown in FIG. 7, and thereafter, are shifted towards the right generally horizontally through a space at a height of about 2 mm from the upper surfaces of the presser feet 62 and 72 so as to reach positions spaced from the positions immediately below the two needles 13 and 14 by approximately 5 mm.

On the other hand, in the split holes 139 of the pair of lower holding rings 138, another set of piston cylinders 160 each having forward ends corresponding to the lower portions of the two needles 13 and 14 are fixedly embraced through clamping by screws as shown in FIG. 7. At the forward ends of piston rods 161 of said cylinders 160, thread cutting scissors N are respectively provided as illustrated in FIGS. 9(*a*) and 9(*b*). In each pair of scissors N, a fixed blade 163 having a sliding portion 164 projecting sidewise is secured, with a spring plate 167 being overlapped on its upper surface, while, between the spring plate 167 and the fixed blade 163, a movable blade 165 having a contact portion 166 extending through an elongated opening 171 formed in a guide wall 170 to be described later, towards the side of the sliding portion 164 of said fixed blade 163 is rotatably provided on the upper surface of the fixed blade 163 through a stepped screw 168, so that, by the rotation of the movable blade 165 about the stepped screw 168 in a state where said movable blade 165 contacts the upper surface of the fixed blade 163 under pressure by the action of the plate spring 167, cutting function is effectbd between the movable blade 165 and the fixed blade 163.

Moreover, at the forward end of each of said cylinders 160, a holding member 169 having the guide wall 170 extending generally in parallel relation with the direction of protrusion of the piston rod 161 is fixedly embraced through clamping by a screw, and by slidably receiving the sliding portion 164 of the fixed blade 163 in the elongated opening 171 formed in the guide wall 170 of the holding member 169 in a direction parallel to the piston rod 161, each of the piston rods 161 is prevented from rotation. Furthermore, on the outer surfaces at base portions of said guide walls 170, contact plates 173 are adjustably fixed by screws for positioning in the direction of protrusion of the piston rods 161, and by the contact of the contact portions 166 of the movable blades 165 retreated by the retraction of the piston rods 161, with the forward ends of said contact plates 173, the movable blades 165 are rotated to be spaced from the forward ends of the fixed blades 163 for opening.

Additionally, at the end portions of the guide walls 170, there are provided contact walls 172 for closing the thread cutting scissors N, and through contact of the contact portions 166 of the movable blades 165 advanced by the protrusion of the piston rods 161, with said contact walls 172, the movable blades 165 are rotated so as to be overlapped on the forward ends of the fixed blades 163 for closing the scissors N.

It is to be noted here that the thread cutting piston cylinders 160 are so arranged for positioning that, upon protrusion of the piston rods 161, the forward ends of the movable blades 165 overlap the corresponding forward ends of the fixed blades 163 provided at the end portions of the piston rods 161, in positions immediately below the two needles 13 and 14 as shown in FIG. 11, with the under faces at the forward ends of the fixed blades 163 being located at a height of about 1 mm above the under faces of the presser feet 62 and 72, whereby the length of the upper thread end above the upper surface of the garment to be sewn is maintained at about 1 mm during cutting at all times.

Functionings of the needle thread cutting device according to the present invention having the constructions as described so far will be explained hereinbelow based on the flow-chart of FIG. 19 with reference to the case where it is applied, for example, to the cycle sewing machine exclusive for belt loop sewing.

As shown in FIGS. 6 and 7, upon turning ON of the start switch (not particularly shown), with the waist portion G of the pair of trousers, slacks, etc., placed on the throat plate 3 of the sewing machine 1 by the operator (step (I)), the material folding and supplying device (not shown) for belt loop formation is actuated, and supplies cut pieces T of the material each having folded end portions so that said opposite ends are brought into positions immediately below the presser feet 62 and 72 as stated previously (step (II)).

In the above state, the piston rods 68 and 78 of the depending cylinders 67 and 77 provided at the front and side portions of the arm 10 are simultaneously advanced so as to lower the presser feet 62 and 72 through the presser bars 66 and 76 so as to depress the folded portions at the opposite ends of the cut pieces T together with the waist portion G of the trousers, etc. (step (III)), and also, to lower by the same amount, the moving pieces 123*a* and 123*b* connected to the upper portions of the presser bars 66 and 76 through the connecting pieces 130. In this case, the moving pieces 123*a* and 123*b* are respectively lowered independently without swaying in the horizontal direction, through guiding by the guide grooves 126 of the erected plates 125 together with the slide shafts 122, and move the thread draw-out piston cylinders 140 and thread cutting piston cylinders 160 integrally provided therebelow through the holding rings 136 and 138, so as to be located at predetermined positions above the presser feet 62 and 72 at all times.

By the above function, the thread draw-out rods 152 and the thread cutting scissors N respectively provided at the forward ends of the piston rods 141 and 161 of the cylinders 140 and 160 are always maintained at predetermined positional relations (in the vertical directions) with respect to the presser feet 62 and 72.

Subsequently, the piston rods 141 of the thread draw-out cylinders 140 are extended for advancing the lead pieces 142 provided at the forward ends thereof along the guide plates 145 as shown in FIG. 10. When the lead pieces 142 start advancing, the guide rods 150 begin to descend along the slide openings 155, and as the lead pieces 142 move farther away from said slide openings 155, the horizontal shafts 148 are first rotated in the direction of an arrow A. Upon turning of the horizontal shafts 148 while advancing, the thread draw-out rods 152 fixed to said shafts 148 are also rotated while advancing simultaneously, so as to displace the hook-like horizontal portions 153 at the forward ends thereof generally slantwise downwardly, from the retreated positions indicated by chain lines in FIG. 11, to positions before the positions immediately below the needles 13 and 14 and spaced upwardly by about 2 mm from the upper surfaces of the presser feet 62 and 72 along a locus indicated by an arrow B, and thereafter, when the arcuate portions 151 of the guide rods 150 have reached the slide holes 155, the shafts 148 are advanced while being rotated, in the direction against the arrow A and opposite to the initial direction according to the curvature of the arcuate portions 151 so as to move the hook-like horizontal portions 153 generally horizontally up to positions spaced towards the right side by about 5 mm from the positions immediately below the two needles 13 and 14.

Subsequently, the sewing machine 1 is started to actuate the needle bar 11 and the horizontally rotating shuttles 6 and 8 and also, to rotate the cloth feeding cam 15 (step (IV)), and the cloth feed table 40 is horizontally moved in the X and Y directions through rollers, levers, links, etc. in the manner as described earlier in detail with reference to FIGS. 3 to 5 (step (IV')). Accordingly, the cut piece T and the waist portion G depressed by the presser feet 62 and 72 are moved in the similar manner as the cloth feed table 40 in correspondence to the vertical movements of the needles 13 and 14 to form the two seams C and D simultaneously as shown in FIG. 2.

Upon completion of the stitching at the two portions as described above, the sewing machine 1 is shut down, and the needles 13 and 14 are stopped at the positions where they are raised by approximately 16 mm from the upper surface of the throat plate 3 as shown in FIG. 10.

Thereafter, the piston rods 141 of the thread draw-out cylinders 140 are retracted so as to cause the lead pieces 142 provided at the forward ends of the piston rods 141 to retreat along the guide plates 145, with simultaneous retraction of the thread draw-out rods 152 also. In the above case, the hook-like horizontal portions at the forward ends of the thread draw-out rods 152 are retreated in the opposite direction (i.e. towards the left) along the locus of the arrow B in FIG. 10 so as to hook up by said horizontal portions 153, the needle threads H leading to eyes of the two needles 13 and 14, from the upper surface at the opposite ends of the cut piece T for drawing out the needle threads by a required length, whereby it becomes possible to maintain the needle thread end portions from the needle eyes at a predetermined necessary length after cutting by the thread cutting scissors, and thus, seam skipping is advantageously prevented in the subsequent sewing to form perfect seams positively.

In the next step, the piston rods 161 of the thread cutting cylinders 160 are protruded so as to advance the needle thread cutting scissors N fixed to the forward ends thereof up to positions below the two needles 13 and 14 (step (V)). In the above case, as shown in FIG. 11, the thread cutting scissors N advance through the lower side of the portions close to the cut piece T, of the needle threads H pulled out in the leftward direction by the thread draw-out rods 152, in the vicinity of the positions before the positions immediately below the two needles 13 and 14, and when the scissors N have moved immediately below the needles 13 and 14, the contact portions 166 of the movable blades 165 of said scissors N contact the contact walls 172 at the forward ends of the guide walls 170 for rotating the movable blades 165 about the stepped screws 168 so as to cut off the needle threads H through cooperation with the corresponding forward ends of the fixed blades 163.

Thereafter, the piston rods 161 of the thread cutting cylinders 160 are retracted to cause the thread cutting scissors N provided at the forward ends of the rods 161 to retreat as shown in FIG. 10, with the contact portions 166 of the movable blades 165 brought into contact with the end portions of the contact plates 173 provided at the base portions of the guide walls 170, and thus, the movable blades 165 are rotated about the stepped screws 168 so as to space the forward ends of said movable blades 165 from the corresponding forward ends of the fixed blades 163.

Subsequently, the piston rods 68 and 78 of the depending cylinders 67 and 77 are retracted to raise the presser feet 62 and 72 through the presser bars 66 and 76 (step VIII)), and also to raise, by the same amount, the moving pieces 123 connected to said presser bars 66 and 76 through the connecting pieces 130 and the thread draw-out cylinders 140 and thread cutting cylinders 160 provided as one unit at the lower portion of the moving pieces **123*a* and 123*b***. In the above case, the waist portion G is released from the depression.

Then, the waist portion G of the trousers and the like is moved up to a next sewing position and the start switch as described earlier is turned on. Thereafter, the operation described so far is repeated for stitching the cut pieces T around the waist portion G.

It is needless to say that in the foregoing embodiment, although the needle thread cutting device has been described with reference to the sewing machine having two needles, it may readily be applied as it is to a sewing machine having a single needle.

As is clear from the foregoing description, according to the embodiment of FIGS. 6 to 11 provided with the needle thread cutting device, it is possible to simultaneously cut off two needle threads, after sewing two portions of the cloth at the same time, by drawing out the two needle threads H leading to the needles 13 and 14 by the predetermined amount and advancing the thread cutting scissors N separately provided from the retreated positions at the side of the needles 13 and 14 up to the portions of the needle threads H under the needles 13 and 14.

Moreover, according to the above embodiment, since the presser feet 62 and 72 are respectively provided independently, with the thread draw-out device and thread cutting scissors being also provided on the moving pieces 123*a* and 123*b* associated with the vertical movement of said presser feet 62 and 72, the distances between the presser feet 62 and 72, and the thread draw-out rods 152 and the thread cutting scissors N, are equal at all times even when the vertical positions of the presser feet 62 and 72 are altered due to difference in thickness of materials to be sewn, the length of the needle thread ends is always kept to be the same.

Furthermore, according to the embodiment of FIGS. 6 through 11, owing to the arrangement that the thread cutting scissors N are provided directly on the forward ends of the piston rods 161 of the piston cylinders 160 so as to automatically effect movements and opening or closure of the thread cutting scissors N continuously through utilization of protrusion of said piston rods 161, not only the construction is extremely simplified, but the thread cutting scissors N, thread cutting scissor opening contact plates 173, and thread cutting scissor closing contact walls 172 which are all mounted on the piston cylinders 160 may be formed into one unit, thus resulting in an extreme simplification of assembly, while seams neat and beautiful when finished, may be obtained, since the length of the needle thread ends drawn out from the upper surface of the garment at the starting of sewing may be reduced to less than a half of such length in the conventional arrangements.

Referring further to FIGS. 12 through 18, a bobbin or looper thread cutting device according to the present invention, which may be further applied to the cycle sewing machine in the embodiment of FIGS. 3 to 5, will be explained hereinbelow. It is to be noted here that, since the cycle sewing machine 1 to be employed for the embodiment of FIGS. 12 through 18 may be generally of the same constructions and functions as that described with reference to FIGS. 3 to 5 and FIGS. 6 to 11 except for the inclusion of the novel bobbin thread cutting device to be described later, detailed description thereof is abbreviated here for brevity with like parts being designated by like reference numerals.

In FIGS. 12 and 14, the horizontally rotating shuttles 6 and 8 each rotatably supported for horizontal rotation about corresponding shafts 209 by hook saddles 208 separately fixed to the sewing machine bed 2, include rotating hooks 211, and shuttle bodies 213 for receiving looper thread bobbins 212 therein so as to effect sewing in cooperation with the two needles 13 and 14 as described previously. The throat plate 3 has protrusions 204 respectively provided to laterally extend along the opposite side edges on the under face of said throat plate 3, and by inserting projections 214 provided on said shuttle bodies 213 into recesses 204*a* formed at central portions of the respective protrusions 204, simultaneous horizontal rotation thereof together with the rotating hooks 211 is prevented.

There are further provided oscillating arms 217 each pivotally supported at the lower ends thereof to inner side faces at corresponding lower end portions of the two hook saddles 208 through horizontal shafts 216. To the central portions of the respective oscillating arms 217, forward ends of piston rods 221 of piston cylinders 220 respectively pivotally supported, at their rear ends, to the inner side face of the bed 2 through shafts 219, are pivotally connected by pins 222. Moreover, forward ends of said oscillating arms 217 are formed into arcuate faces 218 conformed with an arc to be drawn by said forward ends when said oscillating arms 217 oscillate about the horizontal shafts 216, while base portions of arcuate movable blades 225 are secured to said arcuate faces 218, with forward end portions of said movable blades 225 extending outwardly onto the lines of arcs as shown (FIGS. 13 and 14).

The movable blades 225 as described above are respectively disposed under the lower face 3*a* of the throat plate 3 in positions immediately at the side of the two needle holes 4 and 5 formed to extend through said throat plate 3, and are so positioned that the arcuate upper surface of each of the movable blades 225 is subjected to a circular motion through a highest position at approximately the same height as the under surface 3*a* of said throat plate 3. In the forward end portion of each of the movable blades 225, there are further formed a loop spreading portion 226, a blade portion 227, a thread guide groove 228, and a thread hook up notch 229 (FIG. 18). Each of the movable blades 225 is subjected to an arcuate oscillation about the horizontal shaft 216 through action of the piston cylinder 220, and hooks up the bobbin thread U leading from the garment to the bobbin 212, by said notch 229.

To a portion 3*b* on the under face of the throat plate 3, there are respectively fixed stationary blades 230, and blade faces 231 formed at the forward ends of the stationary blades 230 are located at the side of the needle holes 4 and 5, and arranged to contact the corresponding upper faces of the movable blades 225 under pressure, and therefore, the stationary blades 230 are capable of cutting off the looper threads U hooked up by the movable blades 225 at the side portion of the needle holes 4 and 5 in cooperation with the movable blades 225, and thus, make it possible to maintain the length of the bobbin thread end portion from the under surface of the cloth in about 1 mm at all times.

Functions of the bobbin thread cutting device according to the present invention having the construction as described so far will be explained hereinbelow based on the flow-chart of FIG. 19 with respect to the case where it is applied to the sewing machine exclusive for belt loop sewing, and with particular reference to FIG. 14 showing only one of the movable blades 225 for better understanding.

When the sewing machine 1 is in the stopped state, the piston rods 221 of the piston cylinders 220 within the sewing machine bed 2 are projected, and therefore, the movable blades 225 are in a stand-by state as shown in sold lines.

In the above state, upon turning ON of the start switch (not particularly shown), with the waist portion G of the pair of trousers, slacks, etc., placed on the throat plate 3 of the sewing machine 1 by the operator (step (I)), the material folding and supplying device (not shown) for belt loop formation is actuated, and supplies cut pieces T of the material each having the folded end portions so that said opposite ends are brought into positions immediately below the presser feet 62 and 72 as described earlier (step (II)).

Subsequently, the presser feet 62 and 72 are lowered for depression of the folded portions at the opposite ends of the cut pieces T together with the waist portion G of the trousers, etc. (step (III)), while simultaneously, the sewing machine 1 is started to actuate the needles 13 and 14 and the horizontally rotating shuttles 6 and 8, and also, to rotate the cloth feed cam 15 described earlier, and thus, the cloth feed table 40 is horizontally moved in the X and Y directions through rollers, levers, links, etc. in the manner as described earlier in detail with reference to FIGS. 3 to 5 (step (IV')). Accordingly, the cut piece T and the waist portion G depressed by the presser feet 62 and 72 are moved in the similar manner as the cloth feed table 40 in correspondence to the vertical movements of the needles 13 and 14 to form the two seams C and D simultaneously as shown in FIG. 2.

When the sewing machine 1 is shut down upon completion of the above seams at the two positions, the piston rods 221 of the piston cylinders 220 are retracted so as to cause the oscillating arms 217 to pivot in the direction of an arrow R1 through the pins 222 provided at the forward ends thereof as shown in FIGS. 12 and 14 for advancing the movable blades 225 fixed to the forward ends of the oscillating arms 217 up to a position indicated by dotted lines (step (VI)). In the above case, each of the movable blade 225 pivots in an arcuate path about the horizontal shaft 216 provided at the lower end portion of the hook saddle 208 so as to cause the loop spreading portion 226 provided at the forward end of said movable blade 225 to engage the bobbin thread U leading from the waist portion G of the trousers to the bobbin 212, at the upper portion of said bobbin thread between the needle hole 4 or 5 and the under face of the protrusion 204 of the throat plate 3, and thereafter, the bobbin thread U is led to the thread hook-up notch 229 formed at the central portion in the forward end of the movable blade 225 for being hooked up thereby.

In the next step, the piston rods 221 of the piston cylinders 220 are projected so as to cause the oscillating arms 217 to pivot in the direction as indicated by an arrow R2 in FIG. 14 for retreatment of the movable blades 225 provided at the forward ends of the piston rods 221 up to the original stand-by position.

Figure 16:
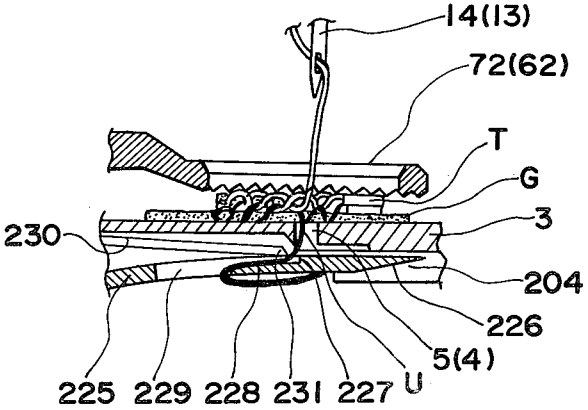
Figure 17:
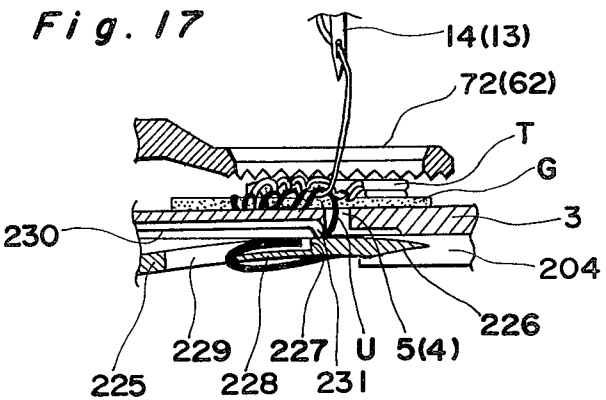

In the above case, the bobbin threads U hooked up by the notches 229 of the movable blades 225 enter the guide grooves 228 during passing of said thread guide grooves 228 of the movable blades 225 through contact with the blade faces 231 of the stationary blades 230, and are simultaneously drawn out from the bobbins 212 by the necessary predetermined length as shown in FIG. 16, and thereafter, cut off by the cutting action of the movable blades 225 and stationary blades 230 when the blade portions 227 of said movable blades 225 reach the corresponding blade portions 231 of the stationary blades 230.

By the above functions, it is possible to maintain the end portion of the bobbin thread from the bobbins 212 at the required length, and seams are positively formed without skipping of thread at the starting of the subsequent sewing.

It should be noted that, in the foregoing embodiment, although the bobbin thread cutting device has been mainly described with reference to the cycle sewing machine having twin needles, the concept of the present invention is not limited in its application to such sewing machine with twin needles alone, but may readily be applied to sewing machines with a single needle.

Accordingly, in the arrangement described so far with reference to FIGS. 12 to 18, it is possible to draw out two bobbin threads U leading from the cloth to the bobbins 212, by the predetermined length and cut them off simultaneously, by causing the separately provided movable blades 225 to reciprocate from the retreated positions at the side of the needle holes 4 and 5 under the throat plate 3, with respect to the portions of the bobbin threads located between the needle holes 4 and 5 and the protrusions 204 of the throat plates 3. Moreover, since the movable blades 225 are directly provided at the forward ends of the oscillating arms 225 pivotally supported for pivotal movement towards the vertical direction by the shaft 216 at the lower ends of the hook saddles 208 which are secured to the bed 2, it is not required to provide any sliding mechanism for horizontally moving the movable blades as in the conventional arrangements, and therefore, the number of parts for the coupling means has been advantageously reduced, with consequent simplification of the construction, improved durability, and reduction in manufacturing cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A cycle sewing machine equipped with a cloth feeding mechanism which comprises a cloth feeding cam (15) driven for rotation at reduced speed in association with rotation of an arm shaft of the cycle sewing machine, said cloth feeding cam (15) being formed, at one side face and an outer peripheral surface thereof, with first and second cam grooves (16) and (17), a feed table (40) horizontally movable in lateral and longitudinal direction of said cycle sewing machine and fixed to a slide shaft (37) so disposed between said cloth feeding cam (15) and a sewing needle of the cycle sewing machine as to be slidable in said lateral direction, said feed table (40) being arranged to be moved in said longitudinal direction by said first cam groove (16) formed at the one side face of the cloth feeding cam (15) through a first oscillating lever (20) vertically provided on the cycle sewing machine, and to be moved in said lateral directions by said second cam groove (17) provided in the outer peripheral surface of said cloth feeding cam (15) through a second oscillating lever (45) horizontally provided on the cycle sewing machine and a link member (55), and a presser arm having a presser foot at its forward end, and supported, at its rear end, by said feed table (40) through a horizontal shaft (60), with said presser foot being directed under said sewing needle.

2. A cycle sewing machine as claimed in claim 1, further comprising a needle thread cutting device which includes a moving piece (123) which is arranged to be vertically movable along a slide shaft (122) through a connecting metal piece (130) and to which movement of a presser bar of the cycle sewing machine is transmitted through the connecting metal piece (130), a thread draw-out piston cylinder (140) disposed under said moving piece (123) and provided with a thread draw-out device in such a manner that a thread draw-out rod (152) provided at a forward end of a piston rod of said thread draw-out piston cylinder (140) is reciprocated with respect to a lower portion of said sewing needle, and a thread cutting piston cylinder (160) disposed under said thread draw-out device and provided with a thread cutting scissor device in such a manner that thread cutting scissors (11) provided at a forward end of a piston rod of said thread cutting piston cylinder (100) are reciprocated with respect to the lower portion of said sewing needle.

3. A cycle sewing machine as claimed in claim 1 or 2, further comprising a bobbin thread cutting device which includes a stationary blade (230) provided on an under surface of a throat plate (3) of the cycle sewing machine in a position at a side of a needle hole (4) or (5) for the sewing needle formed in said throat plate (3), an oscillating arm (217) pivotally supported by a horizontal shaft (216) provided on a bed (2) of the cycle sewing machine, an arcuate movable blade (225) having a loop spreading portion (226), a blade portion (227), a thread guide groove (228), and a thread hook-up notch (229) formed at its forward end portion, and secured, at a base portion thereof, to a corresponding forward end face of said oscillating arm (217), said forward end portion of said arcuate movable blade (226) being projected into an arcuate line for contact with an under surface of said stationary blade (230), said oscillating arm (217) being connected to a piston rod (221) of a piston cylinder (220) so as to be driven thereby for the pivotal movement.

4. A cycle sewing machine having two needles (13) and (14) movably disposed in a longitudinal direction thereof at a predetermined interval and equipped with a cloth feeding mechanism which comprises a cloth feeding cam (15) driven for rotation at reduced speed in association with rotation of an arm shaft of the cycle sewing machine, said cloth feeding cam (15) being formed, at one side face and an outer peripheral surface thereof, with first and second cam grooves (16) and (17), a feed table (40) horizontally movable in lateral and longitudinal directions of said cycle sewing machine and fixed to a slide shaft (37) so disposed between said cloth cam (15) and sewing needles of the cycle sewing machine as to be slidable in said lateral directions, said feed table (40) being arranged to be moved in said longitudinal directions by said first cam groove (16) formed at the one side face of the cloth feeding cam (15) through a first oscillating lever (20) vertically provided on the cycle sewing machine, and to be moved in said lateral directions by said second cam groove (17) provided in the outer peripheral surface of said cloth feeding cam (15) through a second oscillating lever (45) horizontally provided on the cycle sewing machine and a link member (55), and presser arms (61) and (71) having presser feet (62) and (72) at forward ends thereof, and supported, at rear ends thereof, by said feed table (40) through a horizontal shaft (60), with said presser feet (62) and (72) being directed under said needles (13) and (14) by said presser arms (61) and (71), said presser feet (62) and (72) being respectively formed, in upper surfaces thereof, with countersink recesses (65) and (75) in which lower ends of presser bars (66) and (76) which can be properly depressed by cylinders (67) and (77) are received, said presser bars (66) and (76) being arranged to contact said presser feet (62) and (72) by tension springs (64) and (74) at all times.

5. A cycle sewing machine as claimed in claim 4, further comprising a needle thread cutting device which includes two moving pieces (**123*a*) and (123*b*) which are arranged to be vertically movable in parallel relation independently of each other along slide shafts (122) through connecting metal pieces (130) and to which movement of the presser bars (66) and (76) of the cycle sewing machine is transmitted through the connecting metal pieces (130), thread draw-out piston cylinders (140) respectively disposed under said moving pieces (123) and provided with thread draw-out devices in such a manner that thread draw-out rods (152) provided at forward ends of piston rods of said thread draw-out piston cylinders (140) are reciprocated with respect to lower portions of said sewing needles, and thread cutting piston cylinders (160) respectively disposed under said thread draw-out devices and provided with thread cutting scissor devices in such a manner that thread cutting scissors (N) provided at forward ends of piston rods of said thread cutting piston cylinders (100**) are reciprocated with respect to the lower portions of said sewing needles.

6. A cycle sewing machine as claimed in claim 4 or 5, further comprising a bobbin thread cutting device which includes stationary blades (230) provided on an under surface of a throat plate (3) of the cycle sewing machine in positions at sides of needle holes (4) and (5) for the sewing needles formed in said throat plate (3), oscillating arms (217) pivotally supported by horizontal shafts (216) provided on a bed (2) of the cycle sewing machine, arcuate movable blades (225) each having a loop spreading portion (226), a blade portion (227), a thread guide groove (228), and a thread hook-up notch (229) formed at forward end portions thereof, and secured, at base portions thereof, to corresponding forward end faces of said oscillating arms (217), said forward end portions of said arcuate movable blades (226) being projected into arcuate lines for contact with under surfaces of said stationary blades (230), said oscillating arms (217) being connected to piston rods (221) of piston cylinders (220) so as to be driven thereby for the pivotal movement.

* * * * *